US007530906B2

(12) United States Patent
Ono

(10) Patent No.: US 7,530,906 B2
(45) Date of Patent: May 12, 2009

(54) GOLF BALL MANUFACTURING METHOD

(75) Inventor: Hiroyuki Ono, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 346 days.

(21) Appl. No.: 11/477,446

(22) Filed: Jun. 30, 2006

(65) Prior Publication Data

US 2008/0004135 A1 Jan. 3, 2008

(51) Int. Cl.
*A63B 37/00* (2006.01)

(52) U.S. Cl. ..... 473/351; 356/237.1

(58) Field of Classification Search ..... 473/351
See application file for complete search history.

(56) References Cited

U.S. PATENT DOCUMENTS 5,611,723 A 3/1997 Mitoma et al.
6,597,445 B2 7/2003 Sugimoto
7,004,067 B1 * 2/2006 Godsey et al. ..... 101/35
2007/0232411 A1 * 10/2007 Inoue et al. ..... 473/351

FOREIGN PATENT DOCUMENTS

JP 8-229810 A 9/1996
JP 2002-767 A 1/2002

* cited by examiner

*Primary Examiner*—Raeann Trimiew
(74) *Attorney, Agent, or Firm*—Sughrue Mion, PLLC

(57) ABSTRACT

This invention provides a golf ball manufacturing method to be administered subsequent treatment at a specific site on the surface of a ball molded from a golf ball-forming material. The method includes the steps of forming on the surface of the ball an identifying mark having a given positional relationship with the specific surface site; removing each ball in turn from a plurality of lined-up balls on each of which the specific surface site is located in a random position; photographing the identifying mark formed on the surface of the ball with an image processing camera; and, based on information provided by the photographed identifying mark, correcting the orientation of the ball so that the specific surface site lies at the position where the subsequent treatment will be administered. This method of manufacture enables the ball to be reliably and smoothly positioned, thus making it possible to reliably and smoothly carry out subsequent treatment such as seam line processing and marking. The overall efficiency of the golf ball manufacturing process is thus increased, which is advantageous for production.

7 Claims, 5 Drawing Sheets

GOLF BALL MANUFACTURING METHOD

BACKGROUND OF THE INVENTION

The present invention relates to a method of manufacturing various types of golf balls, such as one-piece golf balls and solid golf balls composed of a core enclosed by one or more cover layer. More specifically, the invention relates to a method of manufacturing golf balls in which, to inspect the surface of a ball-shaped molded material obtained after injection molding and to position markings thereon, the ball surface is placed in a reference orientation at a predetermined position.

Horizontally separating two-part molds have hitherto been used as molds for injection molding a cover resin material over a core in the manufacture of golf balls. When such a two-part mold is used, a seam line corresponding to the parting line of the mold appears on the golf ball.

This seam line is convenient for visually inspecting the golf ball and for applying markings to the ball. For example, flash normally forms at the seam line corresponding to the parting line of the two-part mold. When the mark left by the removal of such flash is to be inspected and processing is to be carried out on the ball, by specifying the position of the seam line and placing the ball in the inspection and processing apparatus, inspection and processing can be efficiently carried out. It is thus important to know where the seam line is located, and to position the ball accordingly.

When a marking such as lettering, a design or a trade mark is to be applied onto the seam line of a golf ball, it is essential to know the position of the seam line beforehand.

However, in recent golf balls, to make the arrangement of dimples formed on the surface of the ball as dense and uniform as possible so as to improve the aerodynamic properties and increase the distance of travel, it has become common practice to place a plurality of dimples across the parting line. This has made the seam line on the surface of the ball which corresponds to the parting line of the mold indistinct, so that it is often difficult to discern even when photographed with an image processing camera. Therefore, when inspecting processing of the seam line and inspecting pin marks left from molding, which are subsequent steps carried out after injection molding, it is difficult to accurately position the specific sites where the seam line or pin marks are located, thus compromising the efficiency of operations in the subsequent steps and resulting in a poor precision.

A golf ball is basically a sphere that lacks any distinguishing characteristic other than to be provided on the surface of the ball with dimples. Therefore, when a specific site on the ball's surface is to be inspected or a particular position is to be specified and a marking applied to that position, unless such an operation is carried out on the ball immediately after ball fabrication in the manufacturing process and before the ball is moved, it is difficult to re-locate the specific site. Hence, the environment for ball inspection and the like during the manufacturing process has been less than ideal.

SUMMARY OF THE INVENTION

It is therefore an object of the present invention to provide a golf ball manufacturing method which can smoothly and advantageously carry out operations in a ball visual inspection step and a marking step subsequent to injection molding.

To achieve the above object, the present invention provides a golf ball manufacturing method to be administered subsequent treatment at a specific site on the surface of a ball molded from a golf ball-forming material, which method includes the steps of forming on the surface of the ball an identifying mark having a positional relationship with the specific surface site; removing each ball in turn from a plurality of lined-up balls on each of which the specific surface site is located in a random position; photographing the identifying mark formed on the surface of the ball with an image processing camera; and, based on information provided by the photographed identifying mark, correcting the orientation of the ball so that the specific surface site lies at the position where the subsequent treatment will be administered.

Preferred embodiments of the golf ball manufacturing method of the invention include I to VII below.

I. A golf ball manufacturing method to be administered subsequent treatment at a specific site on the surface of a ball molded from a golf ball-forming material, comprising the steps of forming on the surface of the ball an identifying mark having a given positional relationship with the specific surface site; removing each ball in turn from a plurality of lined-up balls on each of which the specific surface site is located in a random position; photographing the identifying mark formed on the surface of the ball with an image processing camera; and, based on information provided by the photographed identifying mark, correcting the orientation of the ball so that the specific surface site lies at the position where the subsequent treatment will be administered.

II. The golf ball manufacturing method of I above, wherein the orientation of the ball is corrected by rotating the ball in mutually orthogonal X- and Y-axis directions.

III. The golf ball manufacturing method of II above wherein, when the ball is photographed with the image processing camera, the image processing camera photographs the ball from directly above, the ball is rotated in a single step alone or in a plurality of steps so as to position the identifying mark at the top of the ball, following which the identifying mark is rotated by a given angle from the top of the ball so as to position the specific surface site at the top of the ball, thereby orienting the ball to allow subsequent treatment to be carried out from the top of the ball.

IV. The golf ball manufacturing method of I above, wherein the subsequent treatment comprises inspecting a seam line formed on the surface of the ball, and the specific surface site on the ball is the seam line.

V. The golf ball manufacturing method of I above, wherein the subsequent treatment comprises administering a marking or stamp to the surface of the ball, and the specific surface site on the ball is the place where the marking is formed.

VI. The golf ball manufacturing method of I above, wherein the surface of the ball has a mark from a pin or a gate used in molding, the subsequent treatment comprises inspecting the pin mark or gate mark, and the specific surface site on the ball is the pin or gate mark.

VII. The golf ball manufacturing method of VI above, wherein the surface of the ball has a mark from a pin used in molding and the pin mark is formed on a line which is orthogonal to a seam line formed on the surface of the ball.

In the inventive golf ball manufacturing method, the process of positioning a ball molded from a golf ball-forming material for the purpose of administering subsequent treatment to a specific site on the surface of the ball involves first forming on the surface of the ball an identifying mark having a positional relationship with the specific surface site, photographing the identifying mark formed on the surface of the ball with an image processing camera, and using information provided by the photographed identifying mark to correct the orientation of each of a plurality of balls on which the specific surface site is situated in respectively random states.

This method of manufacture enables the ball to be reliably and smoothly positioned, thus making it possible to reliably and smoothly carry out subsequent treatment such as seam line processing and marking. The overall efficiency of the golf ball manufacturing process is thus increased, which is advantageous for production.

BRIEF DESCRIPTION OF THE DIAGRAMS

FIG. 3A is a schematic side view of a first rotating station and a second rotating station, and FIG. 3B is a schematic side view of a third rotating station.

DETAILED DESCRIPTION OF THE INVENTION

The invention is described more fully below in conjunction with the attached diagrams.

Figure 1:
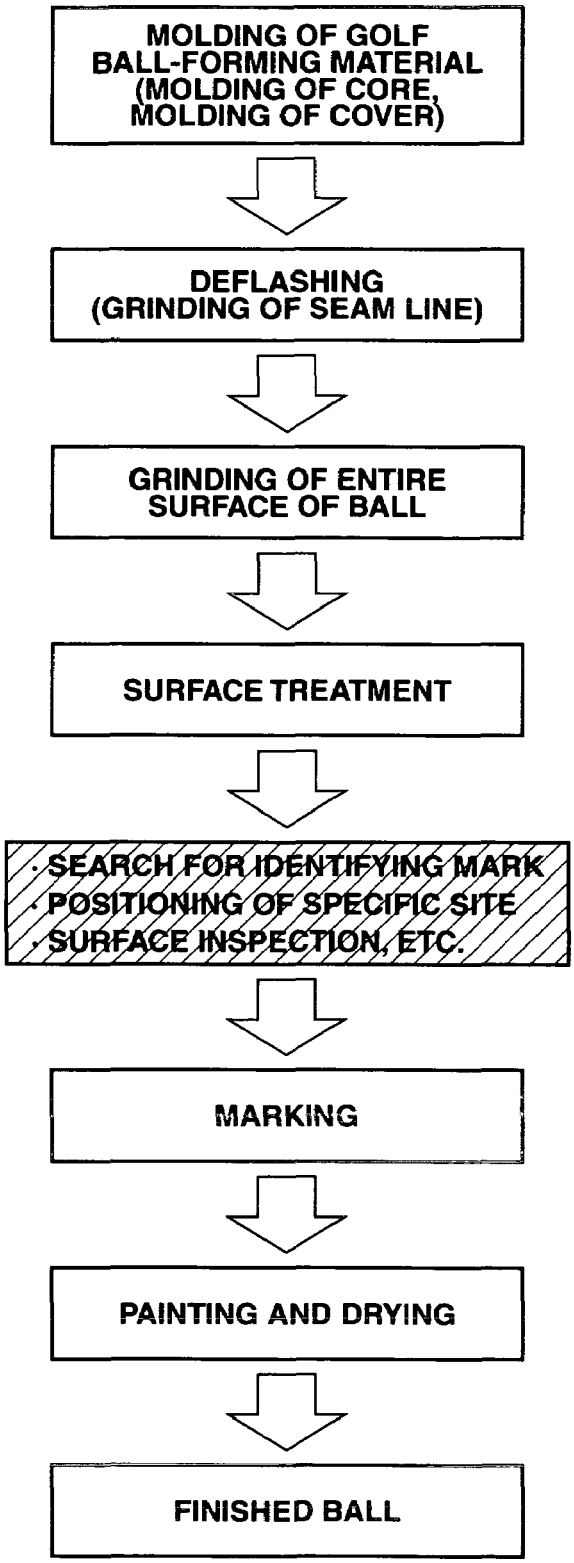
FIG. 1 is a flow chart showing the sequence of steps in the golf ball manufacturing method of the invention.

This invention includes the step of, when a golf ball molded from a golf ball-forming material is to be administered subsequent treatment at a specific surface site, positioning the specific surface site on the ball at a given location. For example, as shown in FIG. 1, after a ball on which an identifying mark has been formed by molding is subjected to various surface treatments, the specific site is positioned by means of the identifying mark, following which marking is administered and painting is carried out, thereby giving a finished golf ball.

"Golf ball-forming material" refers herein to the materials in the respective parts of the golf ball, such as the core and the cover. The core may be any of various types of cores, such as a single-layer solid core, a solid core having a plurality of vulcanized rubber layers, a solid core having a plurality of resin layers, and a thread-wound core having a rubber thread layer. Examples of materials for this purpose include known rubber materials and thermoplastic materials. The cover is a part formed over the core. The cover material is preferably a known thermoplastic resin or thermoplastic elastomer composed primarily of an ionomer resin or a urethane resin. The cover is not limited to one layer, and may be formed so as to have a multilayer construction of two or more layers.

Concurrent with or subsequent to the molding of the above golf ball-forming material, an identifying mark is applied to the surface of each ball. Examples of the identifying mark used on the invention include a marking formed by the mold cavity, a marking formed with special ink, and a punched mark. In connection with the above invention, the present applicant earlier filed U.S. patent application Ser. No. 11/392,586. The invention to which this earlier application relates is a golf ball, and a golf ball-forming mold, on which a recessed and/or raised mark has been formed near a seam line on the surface of the ball so as to enable the position and direction of the seam line to be easily identified. It is suitable to employ the foregoing recessed and/or raised mark as the identifying mark used in the present invention. For further details, reference should be made to U.S. patent application Ser. No. 11/392,586.

Various subsequent treatments are administered to the ball molded from the above-mentioned golf ball-forming material. Examples of such subsequent treatment include treatment in which the seam line formed on the ball surface is inspected, treatment in which a marking or stamp is applied to the ball surface, and treatment in which injection molding pin marks formed on the surface of the ball are removed. It is essential that positioning of a specific site on the ball surface for administering such treatment be carried out before the subsequent treatment step. It is desirable that, for example, the positional relationship between the identifying mark and the seam line, the positional relationship between the seam line and the place where a marking is to be applied, and the positional relationship between the identifying mark and the place where a marking is to be applied, be understood beforehand.

A preferred embodiment of the invention involving treatment in which a marking or stamp is applied onto the seam line is described below in conjunction with FIG. 2.

Figure 2:
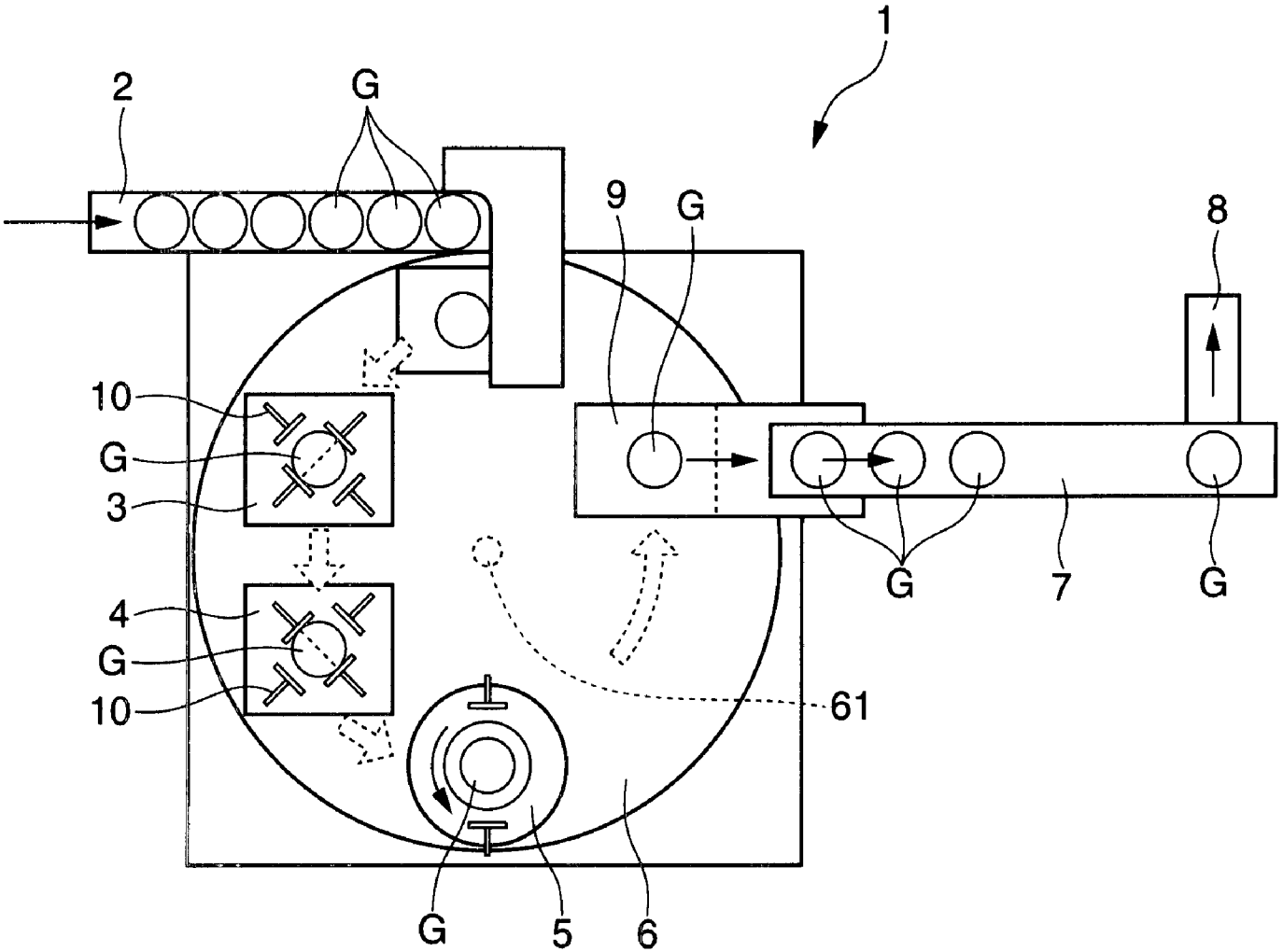
FIG. 2 is a schematic diagram showing an example of an apparatus such as may be used in the manufacturing method of the invention.

The positioning apparatus 1 in FIG. 2 has a feeder 2 in which a plurality of balls G are lined up, a turntable 6 which intermittently transfers balls G to a predetermined location, a first rotating station 3, a second rotating station 4 and a third rotating station 5 which are provided on the turntable and are capable of rotating the ball in one or a plurality of directions, a final correcting station 9 which corrects the orientation of the ball to a predetermined state, and a conveyor 7 which carries out of the apparatus the ball whose orientation has been properly corrected at the correcting station. Also shown in the diagram is a ball discharge outlet 8 which is connected to a marking or stamping device. The turntable 6 turns intermittently about an axis of rotation 61.

A CCD or other type of image processing camera is disposed directly above the ball turning means. This image processing camera photographs from directly above the ball an identifying mark that has been formed on the ball surface.

Each of the plurality of balls G lined up in the ball feeder 2 has a seam line (specific surface site) located at a random position thereon. These balls G are each delivered in turn onto the turntable 6, and the positioning of the respective balls is carried out.

Figure 3:
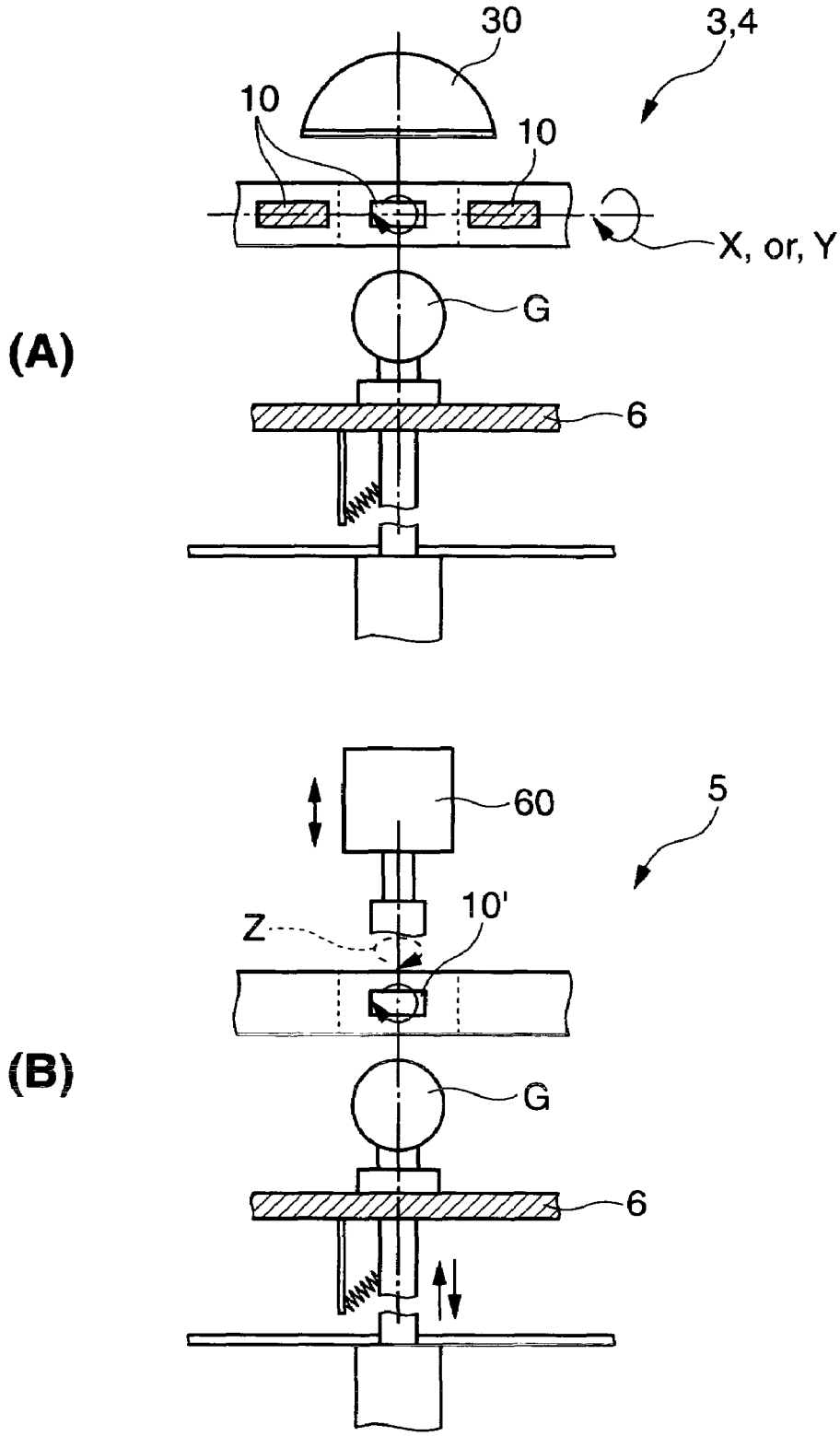
FIG. 3 is a schematic side view illustrating a means for rotating the ball in the apparatus shown in FIG. 2. Here.

Referring to FIG. 3A, when the ball G is photographed with an image processing camera 30, by situating the camera so as to photograph the ball G from directly above and turning the ball G, the identifying mark on the surface of the ball is detected, then moved to the top of the ball G. Referring to FIG. 3B, from information provided by the identifying mark now situated at the top of the ball, the specific site is corrected so as to face in the inspection or marking position. Specifically, use is made of means for rotating the ball G in the directions of the mutually orthogonal X-, Y- and Z-axes. Here, as shown in FIG. 3A, the first rotating station 3 and the second rotating station 4 are used as the means for rotating the ball in the X-axis and Y-axis directions. As shown in FIG. 3B, the third rotating station 5 is used as the means for rotating the ball G in the Z-axis direction and as the means for correcting the specific site. At the first rotating station 3 and the second rotating station 4, rotating means 10 connected to a drive means such as a motor are disposed on both sides of the ball G, and the ball is clamped between the rotating means 10 and turned. At the third rotating station 5, a turning means 60 which rotates the ball G about the Z axis in FIG. 3B is used.

That is, the first rotating station 3 and the second rotating station 4 rotate the ball G by the respective turning means while the identifying mark on each ball is detected with the image processing camera 30. In this case, if necessary, the ball is re-clamped from the X-axis to the Y-axis, and the ball is rotated about the X and Y axes. When the operation at the first rotating station 3 is complete, the ball G is transferred by the turntable 6 to the second rotating station 4. When operation at the second rotating station 4 is complete, the ball G is then transferred by the turntable 6 to the third rotating station 5. This sequence is as indicated by the arrows within the turntable 6 in FIG. 2.

At the third rotating station 5, as shown in FIG. 3B, the ball G is rotated about the Z-axis based on image data obtained from image processing at the second rotating station 4, thereby placing the identifying mark at a given position at the top of the ball G. Next, because this identifying mark already has a fixed positional relationship with the specific surface position, by using a rotating means 10' provided at the third rotating station 5 to rotate the ball through a given angle, the specific surface site (seam line) is appropriately moved to the top of the ball (that is, the top on the axis of the rotating means 10').

Figure 4:
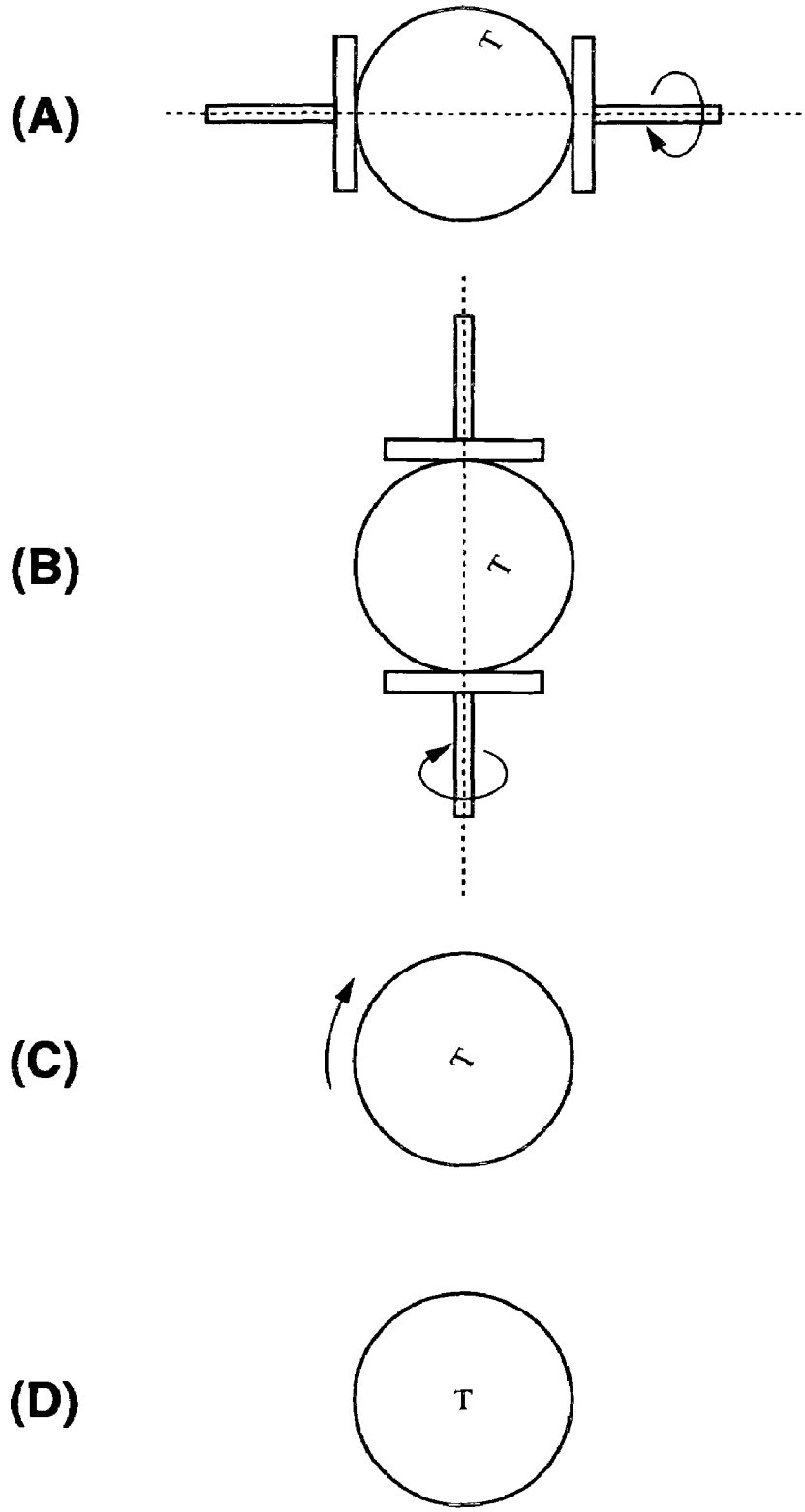
FIG. 4 depicts the rotation of a ball until the orientation of an identifying mark is corrected so as to be at the top of the ball.

Referring to FIG. 4, the manner in which the ball is rotated until the orientation of the identifying mark at the very top of the ball has been corrected is explained. First, the first rotating station 3 rotates the ball about the axis of rotation in FIG. 4A, thereby moving a T-shaped identifying mark that has been formed on the ball surface onto the dashed line serving as the axis of rotation and into the position shown in FIG. 4B. Next, the second rotating station 4 rotates the ball about the axis of rotation in FIG. 4B, thereby moving the T-shaped identifying mark to the center onto the axis of rotation (dashed line) which is perpendicular to that in FIG. 4A and into the position shown in FIG. 4C. Then, at the third rotating station 5, the ball is rotated in the direction of the arrow in FIG. 4C, thereby rotating the T-shaped identifying mark into the proper position as shown in FIG. 4D.

The specific site (seam line) is placed at the top of the ball by the above-described turning means 10'. However, the turntable 6, in transferring the ball to the outlet side, sets the ball in a state that is rotated through a fixed angle as seen from directly above, as a result of which the specific site (seam line) ends up out of position by a given angle. Hence, the disposition of the specific site (seam line) is corrected to the proper position by the final correcting station 9. The final correcting station 9 has the above-described turning means, the mechanism for which is similar to that indicated by the symbol 60 for the third rotating station 5.

Figure 5:
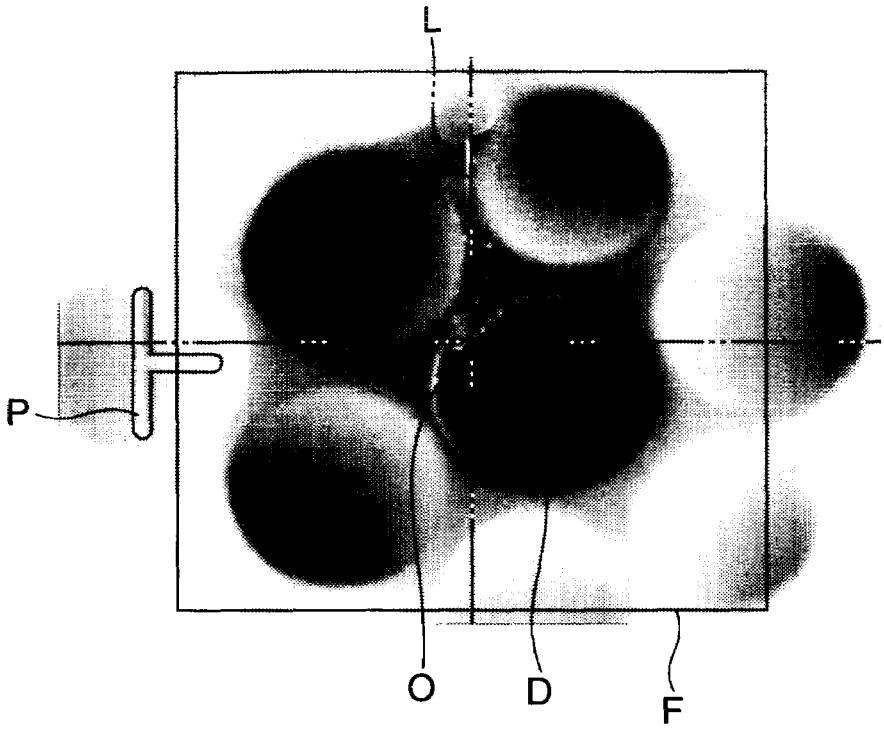
FIG. 5 is a top view showing the surface of a ball as photographed by an image processing camera.

FIG. 5 shows the photographed surface of the ball after the ball has been positioned by the third rotating station 5; that is, after the ball has been turned through a given angle from the identifying mark that was at the very top, based on information provided by the mark, and arranged with the seam line at the very top (center) of the ball. The vertical line at the center of this image frame F is the seam line L, the symbol O is the center of the captured image, the symbol P is the T-shaped identifying mark, and the symbol D is a dimple.

Next, the ball is placed on the conveyor 7 with the seam line (specific surface site) correctly disposed at the top of the ball, and transferred to the discharge outlet 8. The ball is then subjected to subsequent treatment in which a marking such as lettering, a trade mark or a design is marked or stamped onto the seam line of the ball.

The identifying mark formed on the surface of the ball in the above embodiment is effectively employed to position the ball for the marking operation that follows. That is, the identifying mark that has been formed on the ball surface is discerned with an image processing camera and, based on the shape of the identifying mark, the direction and position of the seam line on the ball can be determined. As described above, a ball positioning operation is then reliably and smoothly carried out by rotating the ball a specific amount to correct its orientation so that the seam line is positioned at the very top (center) of the ball.

Figure 6:
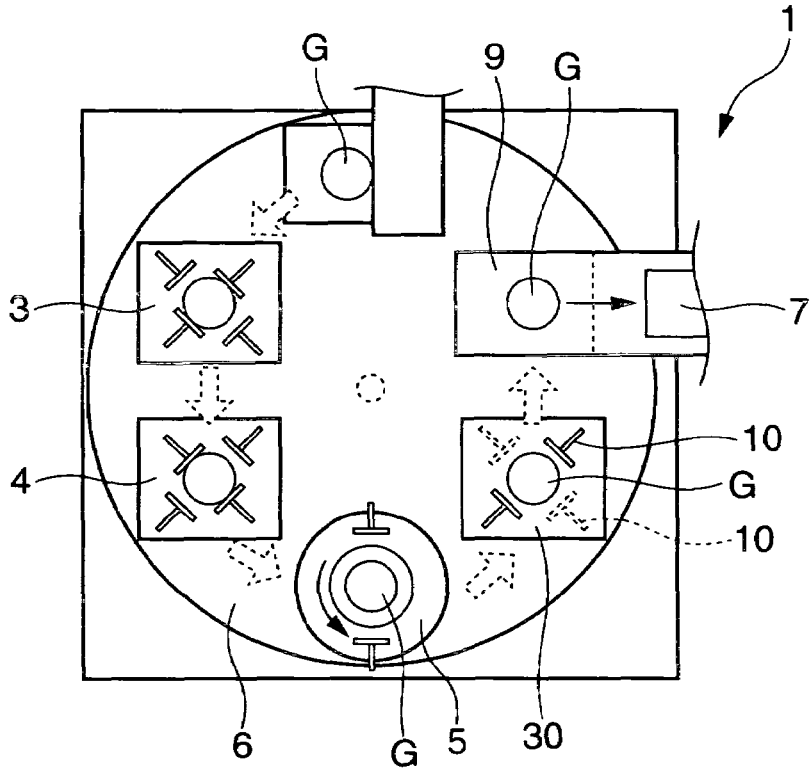
FIG. 6 is a schematic top view showing another example of an apparatus that may be used in the manufacturing method of the invention.

In another embodiment of the invention, as shown in FIG. 6, a new, fourth rotating station 30 may be added between the third rotating station 5 and the final correcting station 9 for the purpose of inspecting processing marks (e.g., flash marks and gate marks) present on the seam line. The mechanism for this fourth rotating station 30 is similar to that of the second rotating station 4.

Some preferred embodiments of the invention have been described above in detail with reference made to the attached drawings. However, the golf ball manufacturing method of the invention is not limited to these embodiments and drawings, and various modifications may be made thereto without departing from the gist of the invention. For example, in FIG. 2, the orientation of the ball was corrected to a given position by rotating the ball in three separate steps. However, an orientation correcting means other than this may be used.

As described above, the golf ball manufacturing method of the invention carries out the operation of, based on information provided by an identifying mark formed on the surface of the ball, correcting to a reference orientation a ball which is to be administered subsequent treatment and on which a specific surface site has been positioned at a predetermined location. As a result, a specific surface site having any random location can be reliably positioned at a predetermined location, which positioning operation is smoothly and very efficiently carried out. This is highly beneficial for the manufacture of golf balls.

The invention claimed is:

1. A golf ball manufacturing method to be administered subsequent treatment at a specific site on the surface of a ball molded from a golf ball-forming material, comprising the steps of forming on the surface of the ball an identifying mark having a given positional relationship with the specific surface site; removing each ball in turn from a plurality of lined-up balls on each of which the specific surface site is located in a random position; photographing the identifying mark formed on the surface of the ball with an image processing camera; and, based on information provided by the photographed identifying mark, correcting the orientation of the ball so that the specific surface site lies at the position where the subsequent treatment will be administered.

2. The golf ball manufacturing method of claim 1, wherein the orientation of the ball is corrected by rotating the ball in mutually orthogonal X- and Y-axis directions.

3. The golf ball manufacturing method of claim 2 wherein, when the ball is photographed with the image processing camera, the image processing camera photographs the ball from directly above, the ball is rotated in a single step alone or in a plurality of steps so as to position the identifying mark at the top of the ball, following which the identifying mark is rotated by a given angle from the top of the ball so as to position the specific surface site at the top of the ball, thereby orienting the ball to allow subsequent treatment to be carried out from the top of the ball.

4. The golf ball manufacturing method of claim 1, wherein the subsequent treatment comprises inspecting a seam line formed on the surface of the ball, and the specific surface site on the ball is the seam line.

5. The golf ball manufacturing method of claim 1, wherein the subsequent treatment comprises administering a marking or stamp to the surface of the ball, and the specific surface site on the ball is the place where the marking is formed.

6. The golf ball manufacturing method of claim 1, wherein the surface of the ball has a mark from a pin or a gate used in molding, the subsequent treatment comprises inspecting the pin mark or gate mark, and the specific surface site on the ball is the pin or gate mark.

7. The golf ball manufacturing method of claim 6, wherein the surface of the ball has a mark from a pin used in molding and the pin mark is formed on a line which is orthogonal to a seam line formed on the surface of the ball.

* * * * *